US006354015B1

(12) United States Patent
Ogasawara et al.

(10) Patent No.: US 6,354,015 B1
(45) Date of Patent: Mar. 12, 2002

(54) DRYING DEVICE

(75) Inventors: Fumihiko Ogasawara; Jun Isozaki; Yoshihiko Fujimura; Yumiko Namba; Hisayuki Kinoshita, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/654,266

(22) Filed: Sep. 1, 2000

(30) Foreign Application Priority Data

Sep. 2, 1999 (JP) ..... 11-248618
Sep. 20, 1999 (JP) ..... 11-265965

(51) Int. Cl.[7] ..... F26B 19/00
(52) U.S. Cl. ..... 34/60
(58) Field of Search ..... 34/60, 1, 2, 3, 34/67, 68; 110/457

(56) References Cited

U.S. PATENT DOCUMENTS

| | | | | |
|---|---|---|---|---|
| 4,127,945 A | * | 12/1978 | Nothen et al. | 34/423 |
| 5,020,244 A | | 6/1991 | Smith | |
| 5,117,562 A | * | 6/1992 | Dulay et al. | 34/550 |
| 5,317,127 A | * | 5/1994 | Brewster, Jr. et al. | 219/388 |
| 5,343,629 A | * | 9/1994 | Rae | 34/278 |
| 5,455,607 A | * | 10/1995 | Rhoads et al. | 347/8 |
| 5,502,475 A | * | 3/1996 | Kaburagi et al. | 347/102 |
| 5,686,224 A | * | 11/1997 | O'Neill | 430/320 |
| 5,712,672 A | * | 1/1998 | Gooray et al. | 347/102 |
| 5,901,462 A | * | 5/1999 | Rudd | 34/274 |
| 5,953,833 A | * | 9/1999 | Rudd | 34/528 |
| 6,062,768 A | * | 5/2000 | Pettersen et al. | 405/158 |
| 6,164,746 A | * | 12/2000 | Akahira et al. | 347/15 |
| 6,256,903 B1 | * | 7/2001 | Rudd | 34/412 |

FOREIGN PATENT DOCUMENTS

| | | |
|---|---|---|
| JP | 7-1749 | 1/1995 |
| JP | 7-17037 | 1/1995 |
| JP | 7-121580 | 12/1995 |
| JP | 8-224871 | 9/1996 |

* cited by examiner

*Primary Examiner*—Tu Ba Hoang
*Assistant Examiner*—Daniel Robinson
(74) *Attorney, Agent, or Firm*—Oliff & Berridge, PLC

(57) ABSTRACT

A drying device capable of keeping substantially constant the temperature of a moving recording sheet and evenly drying it without increasing radiation heat. Though the surface temperature of a recording sheet is lower on the upstream in the drying region and the temperature of outside air blown into the drying region is lower, the temperature of the recording sheet moved in the drying region is kept substantially constant by making the output of the upstream halogen lamp larger than that of the downstream halogen lamp. Even if the airflow velocity in the drying region is different, the radiation heat amount is adjusted according to the velocity to keep substantially constant the temperature of the recording sheet moved in the drying region. Thus, the recording sheet can be evenly dried and even if a jam of the recording sheet occurs in the drying region, there is no possibility of scorching, fuming or the like. The opening of a reflector holder is closed by a plate formed of heat resisting glass, and the plate is disposed parallel to a surface of a platen. By the plate, the airflow is kept from entering the reflector to generate a turbulent flow, but the airflow having passed round the reflector holder to be guided to the platen surface passes through a space formed by the plate and the platen to be rectified. Accordingly, the wind velocity in the space becomes constant, thereby the recording sheet can be evenly dried.

13 Claims, 13 Drawing Sheets

DRYING DEVICE

FIELD OF THE INVENTION

1. Field of the Invention

This invention relates to a drying device for drying recording paper printed by an ink jet head.

2. Description of the Prior Art

In the ink jet printer, characters or images are formed on recording paper by discharged ink. Recently, slow dry black ink has been used to obtain high character image quality, and on the other hand, the print speed has been more and more accelerated. Therefore, incomplete dryness of ink is liable to occur, so it is necessary to quickly dry ink by a drying device.

As shown in FIG. 13, in a drying device 100 disclosed in Japanese Published Unexamined Patent Application No. Hei 8-224871, the upper surface of a single infrared heater 102 is covered with a dome-like hood 104, and a reflector 106 is disposed between the infrared heater 102 and the hood 104.

The drying device 100 is provided with an exhaust fan 108, and the interior pressure of the hood 104 is negative. An inlet port 104A is formed in the hood 104, and the outside air sucked through the inlet port 104A is guided toward recording paper P to dry the recording paper P by radiation heat by the infrared heater 102 and warmed outside air.

The outside air sucked through the inlet port 104A falls straight down toward the recording paper P, and then branches off to the upstream side and the downstream side in the transport direction of the recording paper P to be passed through a gap between the recording paper P and the lower end face 112A of the inner wall 12 of a housing 110 and be guided to the exhaust fan 108 by a blowing space formed between the inner wall 112 and the outer wall 114.

However, since only the single infrared heater 102 is used, the distribution of heat energy received by the recording paper P surface is not uniform, and the interior of the housing 110 of the drying device 100 has a complicated form, so that when the outside air is guided from the lower end face 112A of the inner wall 112 onto the surface of the recording paper P, the ventilating area of the blowing space changes considerably to generate a turbulent flow, resulting in variation in distribution of wind velocity on the recording paper P surface.

Therefore, even if the heat energy amount received by the moving recording paper P surface is set uniform at each point, that is, the distribution of heat radiation energy on the recording paper P surface is set uniform, the temperature (distribution of energy received by the recording paper P) of the recording paper P varies, so that an incompletely dried portion is caused. Accordingly, to evenly drying the recording paper P, it is necessary to increase the radiation heat amount (heat radiation energy) of the infrared heater 102.

Further, it is apprehended that if the recording paper P is exposed to a large amount of radiation heat for a long time due to the occurrence of a jam of the recording paper P in the drying device, scorching or fuming is caused.

SUMMARY OF THE INVENTION

The present invention has been made in view of the above circumstances and provides a drying device capable of evenly drying recording paper by keeping the temperature of the moving recording paper substantially constant without any increase in the heat radiation amount (heat radiation energy).

According to an aspect of the present invention, the drying device has a heating element for drying recording paper printed by an ink jet head. Below the heating element, a platen to which the recording paper is transported is disposed, and the radiation heat of the heating element is reflected toward the platen by a reflector.

Further, a space is formed between the heating element and the platen surface, and an airflow is generated in the space by an airflow generating unit. On the other hand, an energy adjusting unit is provided to keep the temperature of recording paper moved in the space substantially constant.

By this arrangement, in the case where the wind velocity of the airflow is constant in the space, for example, comparing between the upstream and the downstream in the drying region (space), the surface temperature of the recording paper is also lower and also the temperature of the outside air blown into the drying region is lower on the upstream, so that the radiation heat amount is made larger on the upstream than on the downstream. Thus, the radiation heat amount is adjusted so that the temperature of moving recording paper is substantially constant both on the upstream and on the downstream in the drying region.

In the case where the velocity of the airflow is different in the drying region, the radiation heat amount in the higher velocity region is made larger than that in the lower velocity region. Thus, the radiation heat amount is varied according to the velocity of the airflow or the like so that the recording paper is evenly dried and when a recording paper jam occurs in the drying device, there is no possibility of scorching, fuming or the like.

According to another aspect, the drying device has plural heating elements disposed along the transport direction of recording paper, and the output of the individual heating element is varied to adjust the radiation heat amount.

Thus, the plural heating elements are disposed in the transport direction of recording paper, whereby as compared with the case of drying recording paper with a single recording element, near infrared rays and radiation heat are not concentrated so that the recording paper is evenly dried. Further, the output of an individual heating element is made differ so that the temperature of the recording paper moved in the drying region is substantially constant.

According to another aspect of the invention, the drying device has plural heating elements disposed along the transport direction of recording paper and respectively varied in the clearance from a platen so that the temperature of recording paper moved in the drying region is substantially constant.

According to another aspect of the invention, the drying device has plural heating elements disposed along the transport direction of the recording paper, and the space between the heating elements is varied so that the temperature of recording paper moved in the drying region is substantially constant.

According to another aspect of the invention, the distance of a reflector from the platen is varied so that the temperature of recording paper moved in the drying region is substantially constant.

According to another aspect of the invention, the drying device has plural heating elements disposed along the transport direction of the recording paper. The heating elements are divided into each heating element by partition plates, and the respective heating elements are demarcated. Therefore, even with the heating elements having the same output, the demarcating size is varied to adjust the amount of radiation heat applied to moving recording paper.

According to another aspect of the invention, the drying device has a heating element disposed in a housing demarcating the drying region for drying recording paper printed by an ink jet head. Below the heating element, a platen to which the recording paper is transported is disposed, and the radiation heat of the heating element is reflected toward the platen by a reflector.

Further, a space is formed between the heating element and the platen, and an airflow is generated in the space by an airflow generating unit.

On the other hand, an airflow rectification unit is provided opposite to the platen in the space, and an airflow is rectified by the airflow rectification unit. Therefore, the wind velocity in the drying region becomes constant so that the recording paper is evenly dried.

As an airflow generating unit, an intake fan, for example, is provided and the taken outside air is abutted to the housing, and the outside air is flowed into the space formed by the housing and the reflector to prevent overheat of the heating element and restrain a temperature rise in the drying region. Further, an exhaust fan is provided to quickly discharge moist air touching the print surface of the recording paper, so that dew condensation in the housing can be prevented.

According to another aspect of the invention, the velocity of the airflow rectified by the airflow rectification unit is set 1 m/sec or faster. Thus, the airflow is passed on the surface of recording paper at a rate of 1 m/sec, whereby even in the case where a jam of recording paper occurs in the drying device and the recording paper is exposed to radiation heat for a long time, the recording paper is kept from overheating so that scorching, fuming or the like can be prevented.

According to another aspect of the invention, the ventilation area on the downstream side of the blowing space formed between the airflow rectification unit and the platen is made smaller than that on the upstream side.

Thus, even if the loss of fluid energy is caused as it goes downstream in the drying region by a resistive material such as a star wheel or the like disposed in the drying region, lowering of velocity of the airflow can be prevented by reducing the ventilation area on the downstream.

According to another aspect of the invention, the airflow rectification unit is a plate having an infrared ray transmittance of 90% or more. Therefore, the loss of heat radiation energy on recording paper surface can be restrained so that the heat radiation energy required for drying can be used efficiently.

According to another aspect of the invention, the plate is heat resisting glass. Since the heat resisting glass has a high thermal deformation temperature, problems such as cracks or deformation are not caused even in the drying region.

According to another aspect of the invention, the drying device includes heating elements provided in a housing demarcating the drying region for drying recording paper printed by an ink jet head, a platen disposed below the heating elements, to which the recording paper is transported, and a reflector for reflecting the radiation heat of the heating elements toward the platen, and the drying device further includes an airflow generating unit that generates an airflow in a space formed between the heating elements and a surface of the platen, an airflow rectification unit provided opposite to the platen in the space that rectifies the airflow, and an energy adjusting unit that keeps substantially constant the temperature of the recording paper moved in the space. Accordingly, the effects of the invention can be obtained, and as the drying device of the invention has the airflow rectification unit that rectifies an airflow, the energy adjusting unit is capable of stably adjusting the heat radiation energy much more easily and quickly than the drying device without the airflow rectification unit, so that the temperature of recording paper moved in the space can be substantially constant.

BRIEF DESCRIPTION OF THE DRAWINGS

A preferred embodiment of the present invention will be described in detail based on the followings, wherein:

FIG. 6A shows the case where two halogen lamps are used;

FIG. 6B shows the case where three halogen lamps are used;

FIG. 7A shows the case where two halogen lamps are used, and FIG. 7B shows the case where three halogen lamps are used;

FIG. 8A shows the case where two halogen lamps are used, and FIG. 8B shows the case where three halogen lamps are used;

FIG. 10A shows the case where two halogen lamps are used, and FIG. 10B shows the case where three halogen lamps are used;

DESCRIPTION OF THE PREFERRED EMBODIMENT

Figure 1:
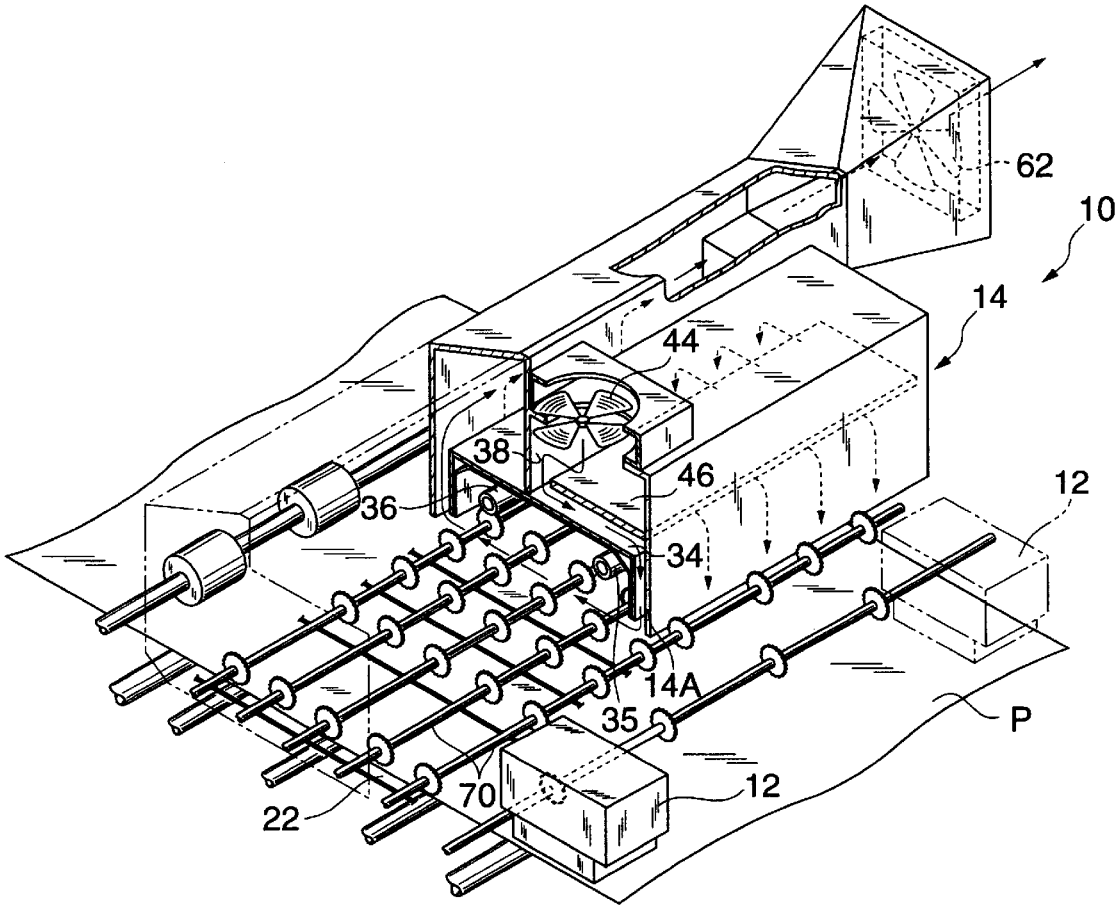
FIG. 1 is a perspective view showing a drying device according to an embodiment of the invention.
Figure 2:
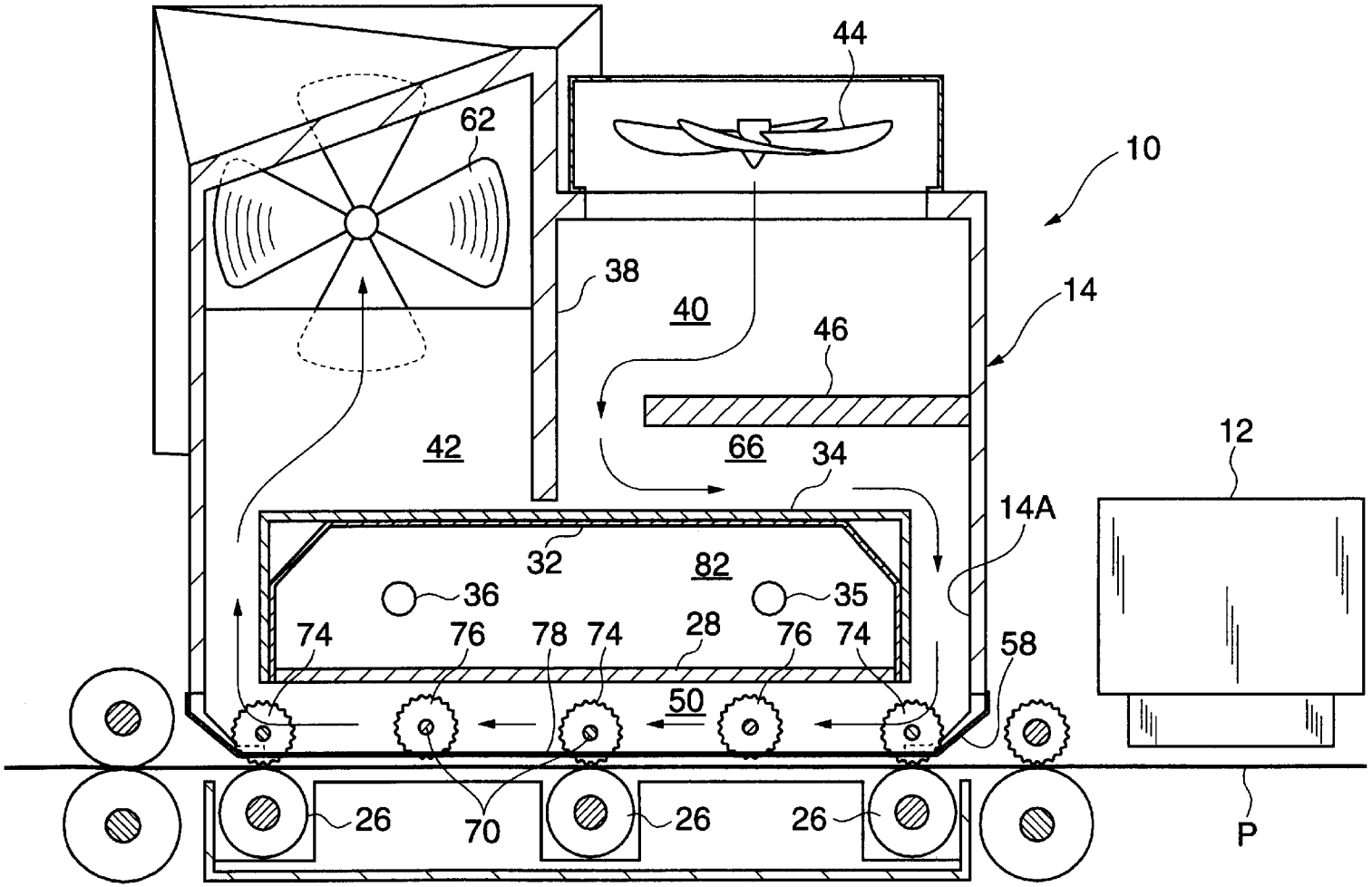
FIG. 2 is a side sectional view showing the drying device according to the embodiment of the invention.

FIGS. 1 and 2 illustrate a drying device 10 according to the embodiment of the invention.

The drying device 10 is disposed adjacent to an ink jet head 12. The respective ink jet heads 12 for injecting black, magenta, cyan and yellow are mounted on a carriage not shown, and the carriage is scanned in the direction intersecting perpendicularly to the transport direction of recording paper P to inject ink to the recording paper P.

The recording paper P high-speed printed by the ink jet heads 12 is sequentially transported for the nozzle width (not shown) of the ink jet head 12 to be transferred to the drying device 10.

The drying device 10 is adapted to evaporate moisture of ink impacted in the recording paper P by near infrared light, radiation heat and hot air of a heating element to dry the recording paper P by passing the recording paper P between the heating element and the transport path surface.

The drying device 10 will now be described in detail.

Figure 3:
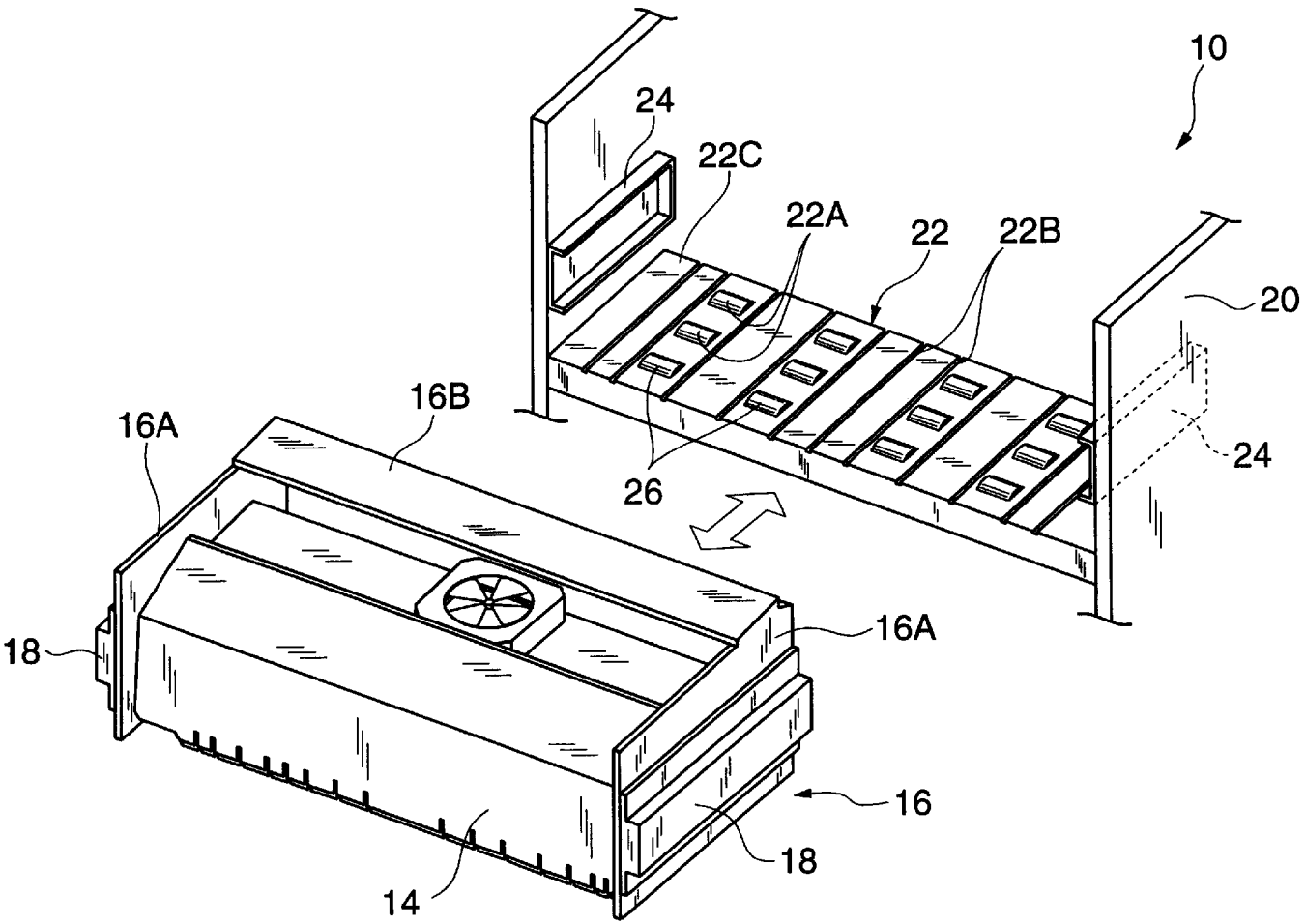
FIG. 3 is a perspective view showing the condition where a housing used in the drying device according to the embodiment of the invention is drawn out of the main body frame.

The drying device is provided with a box-like housing 14, the base (drying region) of which is opened. The housing 14 is, as shown in FIG. 3, held in a housing holding member 16 (not shown in FIGS. 1 and 2) formed by bending both ends of a rectangular plate.

A placing piece not shown is fixed to the inner lower sides of a pair of side walls 16A of the housing holding member 16, and the housing 14 is installed on the placing piece. A flange 16B is laid between the upper end parts of the side walls 16A, whereby the housing holding member 16 is made easy to carry. Further, on the outside of the side wall 16A, a substantially C-shaped movable rail 18 is provided along the transport direction of the recording paper P (see FIG. 1).

On the other hand, a main body frame 20 loaded with the housing holding member 16 is provided with a platen 22. The platen 22 constitutes the transport path surface for the recording paper P, rectangular holes 22A are formed in the top face 22C of the platen 22, and transport rollers 26 are exposed through the rectangular holes 22A to transport the recording paper P on the platen 22.

On the top face 22C of the platen 22, plural ribs 22B are formed along the transport direction of the recording paper P, whereby the recording paper P is kept from adhering to the transport path surface due to static electricity to cause a jam.

The inner wall of the main body frame is provided with a pair of guide rails 24 where the movable rails 18 are engaged, and the movable rails 18 are engaged with the guide rails 24 to slide along the transport direction of the recording paper P.

By this arrangement, the housing 14 is drawn out on the platen 22 along the transport direction of the recording paper P with respect to the main body frame 20. Therefore, when maintenance is conducted or a jam of the recording paper P occurs, a user can easily cope with such a situation.

On the other hand, as shown in FIGS. 1 and 2, plural star wheel support shafts 70 are fixed to the side wall 14B of the housing 14, and plural star wheels 74, 76 are rotatably supported on the star wheel support shafts 70.

The start wheels 74, 76 are thin-walled so that they will not intercept near infrared light from a halogen lamp 36 as a heating element and also undried ink is kept from being again transferred to the recording paper P.

The star wheel 74 is disposed opposite to the transport roller 26 to follow up the transport roller 26, so that the transport force for the recording paper P is improved. Further, the recording paper P is clamped and transported by the start wheel 74 and the transport roller 26, thereby coping with deformation of the recording paper P or floating of the recording paper P to prevent the occurrence of a jam.

Further, the start wheel 76 is positioned above a nip point of the start wheel 74 and the transport roller 26, and only when the recording paper P gets dry to be deformed and floated, the recording paper P comes into contact with the start wheel 76. Thus, it is taken into consideration that the star wheel 76 comes into contact as little as possible with the recording paper P.

On the other hand, at the base of the housing 14, a guard wire 78 is disposed extending over the whole region in the cross direction of the recording paper P to complete the function of the star wheel 76. Thus, a jam of the recording paper P in the housing 14 can be reduced.

A substantially channel-like reflector 32, the corners of which are cut in a side view to be trapezoidal, is disposed in the central part of the housing 14. In the interior of the reflector 32, two halogen lamps 35, 36 are disposed along the transport direction of the recording paper P, and near infrared light of the halogen lamps 35, 36 is reflected toward the recording paper P.

The length (length in the longitudinal direction of the recording paper P surface) of the halogen lamps 35, 36 and the reflector 32 is equal to or larger than the maximum paper width of recording paper P to be printed, so that uneven drying is not caused in the same recording paper P.

Plural halogen lamps 35, 36 are disposed, whereby as compared with the case of drying the recording paper P with a single halogen lamp 102 (FIG. 11), near infrared light and radiation heat are hardly concentrated so that the recording paper P is evenly dried.

On the other hand, on the top face of the reflector 32 is disposed parallel to the platen 22, and on the outside of the reflector 32, a channel-like reflector holds 34 is disposed to support the reflector 32.

Preferably an airflow rectification unit for rectifying an airflow is provided in an opening part (in the drying region) of the reflector holder 34. For example, the opening part is closed by a plate 28 formed of heat resisting glass, and the plate 28 is disposed parallel to a surface of the platen 22.

By the plate 28, an airflow is kept from entering the reflector 32 to generate a turbulent flow, but the airflow passed round the reflector holder 34 to be guided to the platen 22 surface is passed through a blowing space 50 formed by the plate 28 and the platen 22 to be rectified. Therefore, the wind velocity in the blowing space 50 becomes constant so that the recording paper P can be evenly dried.

Further, since the platen 28 is formed of heat resisting glass, the transmittance of infrared rays is high. Therefore, the loss of heat radiation energy on the recording paper surface can be restrained, so that the heat radiation energy required for drying can be used efficiently. Further, since the heat resisting glass has a high thermal deformation temperature, the problems of cracks and deformation will not be caused even in the drying region.

Though the heat resisting glass is used as the plate 28 in the embodiment, this is not restrictive, and any material may be used if it has transmittance of infrared ray of 90% or more and heat resistance.

Figure 4:
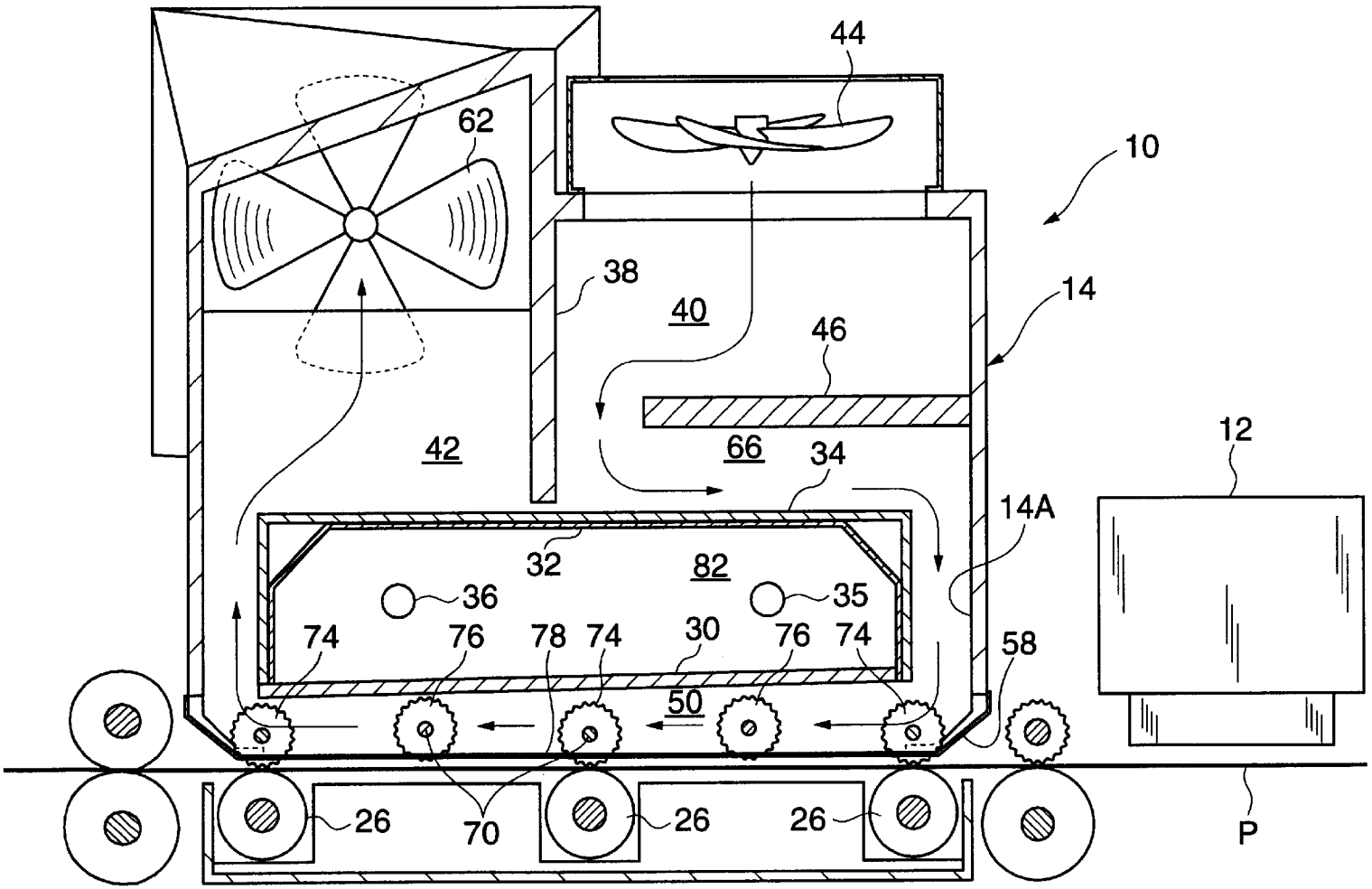
FIG. 4 is a side sectional view showing a modified form of a plate used in the drying device according to the embodiment of the invention.

As shown in FIG. 4, a plate 30 may be inclined to gradually make the ventilation area on the downstream smaller than the ventilation area on the upstream.

Thus, even if the loss of fluid energy is caused by plural star wheels 74, 76 and the like disposed in the drying region as it goes downstream in the drying region, for example, lowering of the airflow velocity can be prevented by reducing the ventilation area on the downstream.

Further, since the plate is formed of heat resisting glass, the transmittance of infrared ray is high. Therefore, the loss of near infrared light onto the recording paper P surface can be restrained so that near infrared light required for drying can be used efficiently. Further, since the heat resisting glass has a high thermal deformation temperature, problems such as cracks and deformation will not be caused even in the drying region 82.

Figure 5:
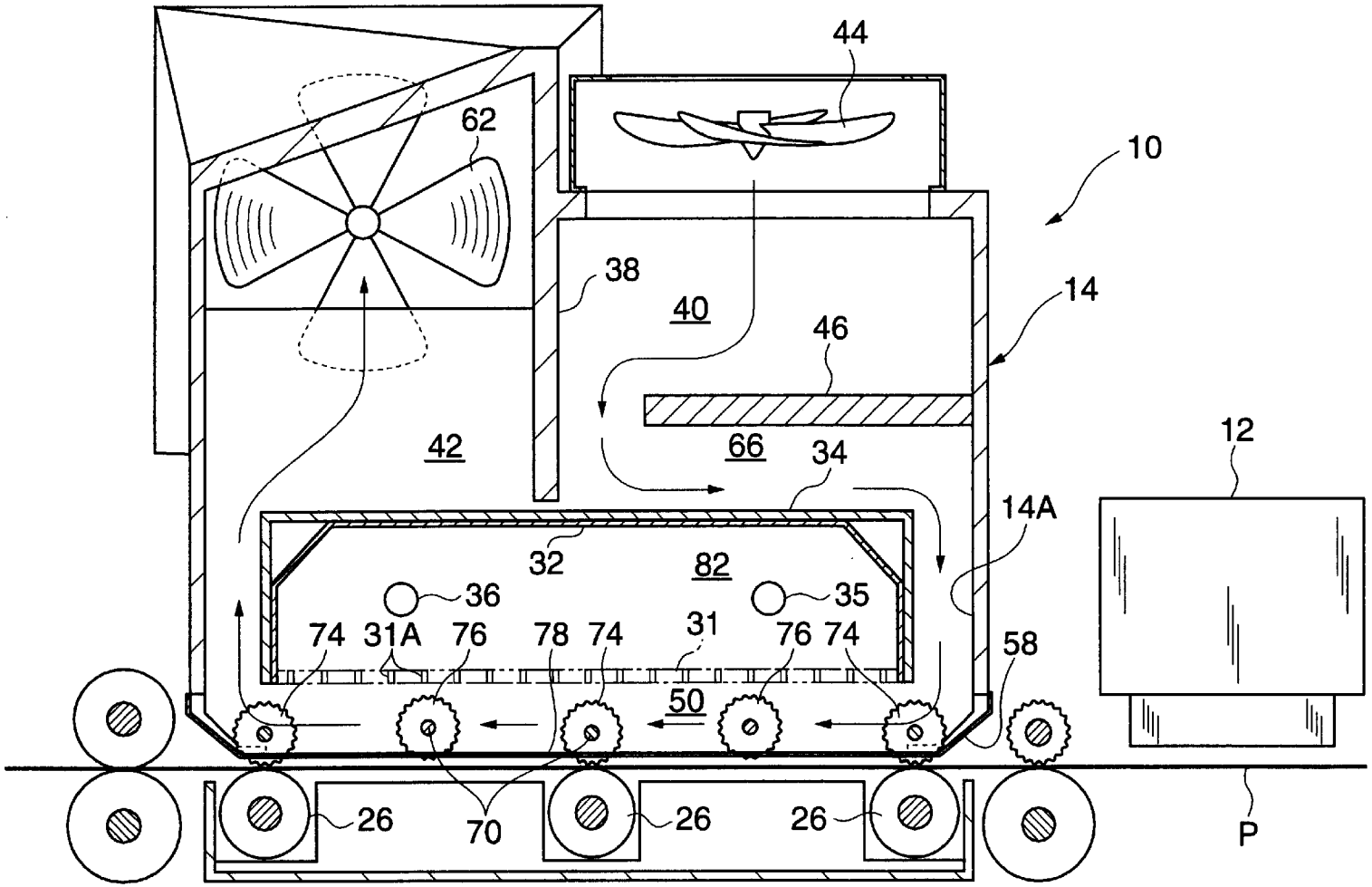
FIG. 5 is a side sectional view showing another modified form of a plate used in the drying device according to the embodiment of the invention.

Instead of the plate 28 (see FIG. 2), as shown in FIG. 5, a metallic mesh 31 of a honeycomb structure may be used as an airflow rectification unit. A hole part 31A of the mesh 31 is formed vertically to the platen 22 surface.

Therefore, the radiation head energy of the halogen lamps 35, 36 is not intercepted, but the blowing passage to the reflector side is formed by the hole part 31A so that the wind velocity tends to slightly decrease as it goes downstream.

However, as compared with the case where the mesh 31 is not used, the occurrence of a turbulent flow is far less likely. To prevent lowering of the wind velocity, the mesh 31 is inclined so that the ventilation area on the downstream is reduced more than the ventilation area on the upstream.

The mesh 31 is formed by the thin walled metal to reduce the area of shielding the recording paper P to the utmost. Further, it is desirable that the mesh 31 is mirror-finished not to absorb radiation heat of the halogen lamps 35, 36.

Figure 6A:
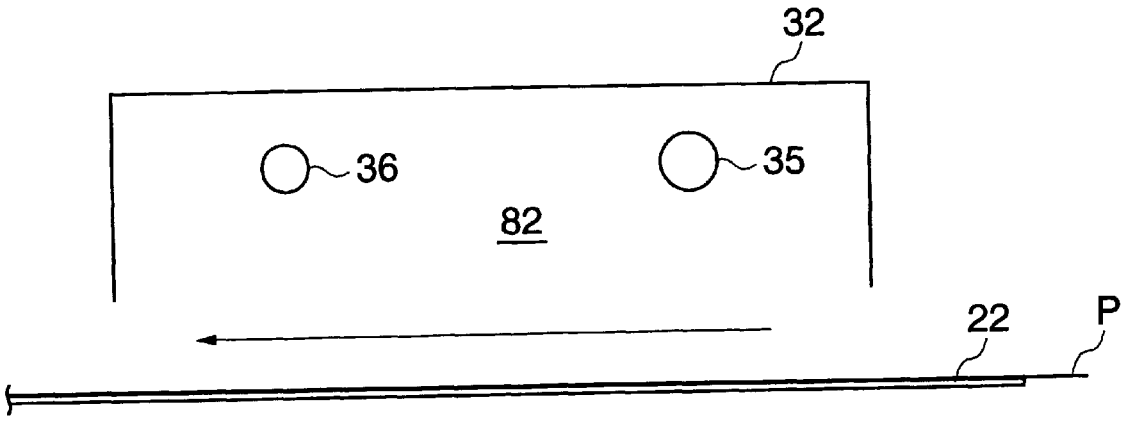
FIGS. 6A and 6B are schematic diagrams showing the output value of a halogen lamp used in the drying device according to the embodiment of the invention.

Subsequently, the energy adjusting unit will be described in detail. As shown in FIG. 6A, the output of the halogen lamp 35 on the upstream of the drying region 82 is 350 W, and the output of the halogen lamp 36 on the downstream is 250 W.

Comparing the upstream with the downstream in the drying region 82, the surface temperature of the recording paper P is lower and also the temperature of outside air blown into the drying region 82 is lower on the upstream, but the temperature of the moving recording paper P is made substantially constant between the upstream and the downstream of the drying region 82 by making the output of the halogen lamp 35 on the upstream larger than that on the downstream.

In the drying region 82, the velocity of the airflow tends to become slightly lower due to the start wheels 74, 76 and the like as it goes downstream as compared with the upstream.

Thus, even in the case where the velocity of the airflow in the drying region 82 is different, the radiation heat amount is made larger in the higher velocity region than that in the lower velocity region, resulting in adjusting the heat radiation amount according to the velocity of the airflow in the drying region 82 so that the temperature of the moving recording paper P is substantially constant on the upstream and on the downstream in the drying region 82.

Accordingly, the recording paper P is dried evenly, and even if a jam of the recording paper P is caused in the drying region 82, there is no possibility of scorching, fuming and the like.

Figure 6B:
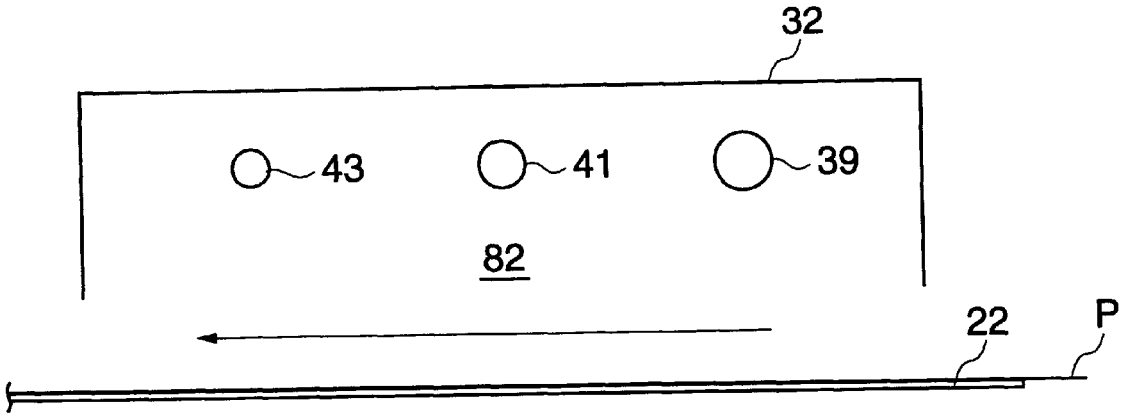

As shown in FIG. 6B, in the interior of the reflector 32, three halogen lamps 39 (250 W), 41 (200 W), 43 (150 W) may be disposed at equal spaces. For the increase in number of halogen lamps, the output of each halogen lamp 39, 41, 43 can be made smaller as compared with that of FIG. 6A.

Figure 7A:
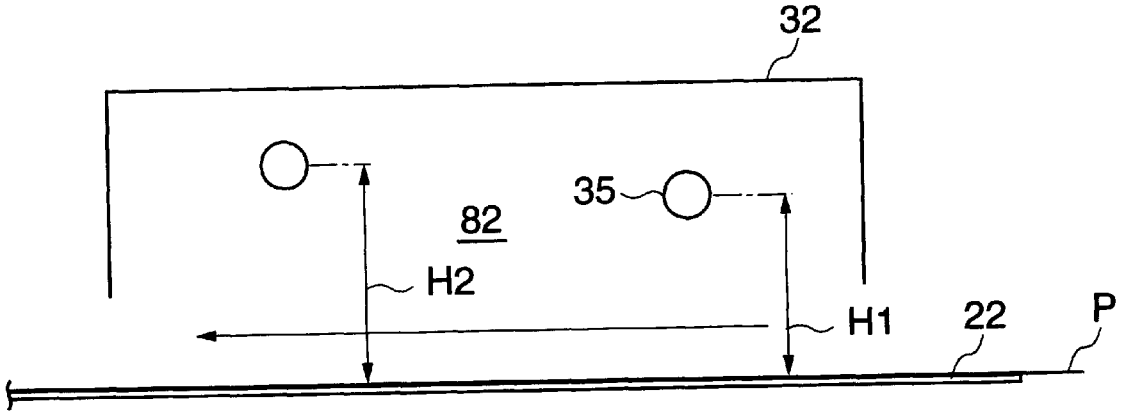
FIGS. 7A and 7B are schematic diagrams showing the clearance between the halogen lamp and a platen used in the drying device according to the embodiment of the invention.

As shown in FIG. 7A, the clearances between the respective halogen lamps 35 (300 W), 36 (300 W) and the platen 22 may be individually varied.

The clearance H1 between the halogen lamp 35 and the platen 22 is made smaller than the clearance H2 between the halogen lamp 36 and the platen 22, whereby the radiation heat amount received by the recording paper P is enlarged on the upstream of the drying region 82.

Thus, the clearances between the halogen lamps 35, 36 and the platen 22 may be adjusted to adjust the radiation heat amount of the recording paper P directly received from the halogen lamps 35, 36 in the drying region 82.

Accordingly, on the upstream of the drying region 82, the surface temperature of the recording paper P is lower than that on the downstream and the temperature of outside air blown into the drying region 82 is also lower, but the temperature of the moving recording paper P is substantially constant between the upstream and the downstream in the drying region 82.

Figure 7B:
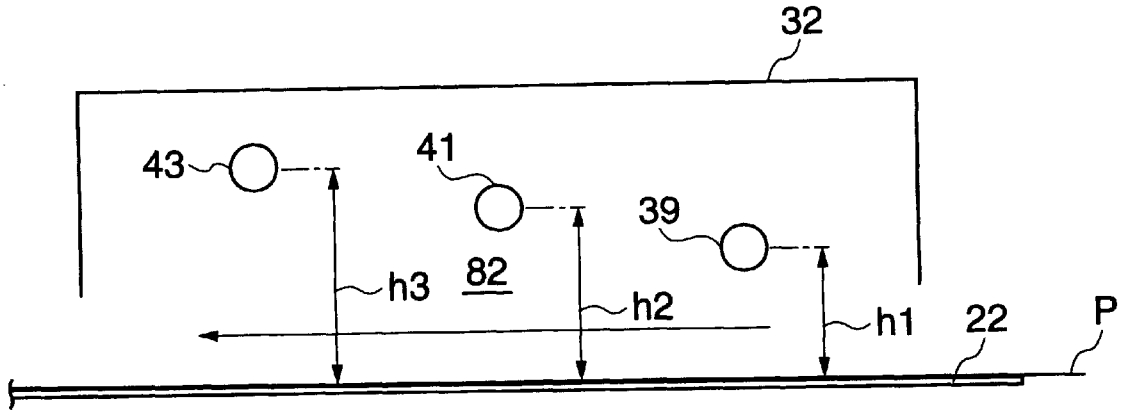

As shown in FIG. 7B, in the case where three halogen lamps 39 (200 W), 41 (200 W), 43 (200 W) are disposed at equal spaces in the interior of the reflector 32, the output of each of the halogen lamps 39, 41, 43 can be made smaller similarly to FIG. 6B.

When the clearance between the halogen lamp 39 and the platen 22 is taken to be h1, the clearance between the halogen lamp 41 and the platen 22 is taken to be h2, and the clearance between the halogen lamp 43 and the platen 22 is taken to be h3, the halogen lamps 39 41, 43 are disposed to have the relationship expressed by $h1<h2<h3$.

Thus, the temperature of the moving recording paper P can be made more constant between the upstream and the downstream in the drying region 82 as compared with that in FIG. 7A.

Figure 8A:
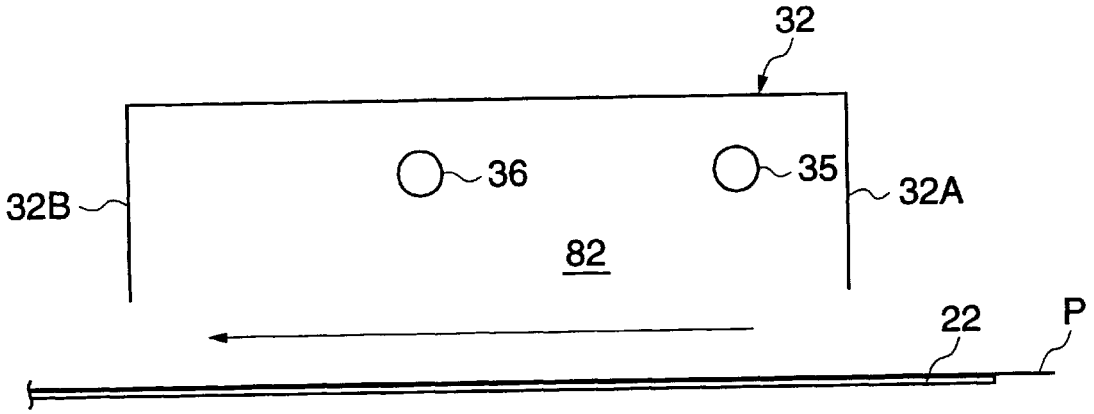
FIGS. 8A and 8B are schematic diagrams showing the clearance between the halogen lamps used in the drying device according to the embodiment of the invention.
Figure 8B:
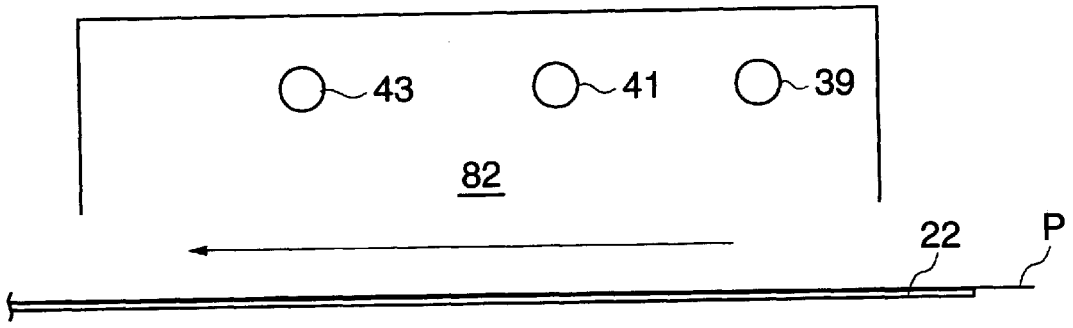

As shown in FIG. 8B, the clearance between the halogen lamps 39 (200 W) and 41 (200 W) or the clearance between the halogen lamps 41, 43 (200 W) may be varied.

Thus, in a portion where the halogen lamps are thickly disposed, the radiation heat amount for raising the temperature of the recording paper P becomes larger, and in a portion where the halogen lamps are thinly disposed, the radiation heat amount for raising the temperature of the recording paper P becomes smaller.

Thus, the radiation heat amount can be adjusted according to the clearance between the halogen lamps, so that the temperature of the moving recording paper P is substantially constant between the upstream and the downstream in the drying region 82.

In FIG. 8A, the clearance between the side wall 32A of the reflector 32 and the halogen lamp 35 (300 W) is different from the clearance between the side wall 32B of the reflector 32 and the halogen lamp 36 (300 W). That is, the arrangement of the heat sources in the reflector is such that the density of the arrangement on the upstream is made lower than that on the downstream in the blowing direction.

The halogen lamp 35 is disposed near the side wall 32A, and the halogen lamp 36 is disposed in a position a little apart from the side wall 32B. Therefore, on the upstream of the recording paper P, the radiation heat amount for raising the temperature of the recording paper P by radiation heat of the halogen lamp 35 is large, and on the downstream, the radiation heat amount for raising the temperature of the recording paper P by radiation heat of the halogen lamp 36 is small.

Thus, the temperature of the moving recording paper P is kept substantially constant between the upstream and the downstream in the drying region 82.

On the other hand, as shown in FIG. 2, the top face of the reflector 32 is disposed parallel to the platen 22, so that the heat energy amount of the recording paper P received from the halogen lamps 35, 36 in an arbitrary position in the drying region 82 is made uniform. On the outside of the reflector 32, the channel-like reflector holder 34 is disposed to support the reflector 32.

Figure 9A:
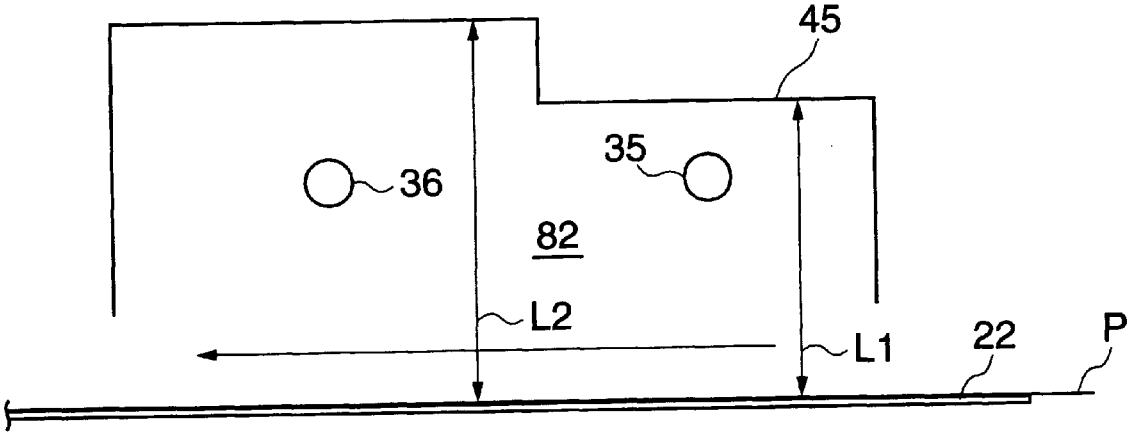
FIGS. 9A and 9B are schematic diagrams showing the position of a reflector to the platen of the drying device according to the embodiment of the invention.
Figure 9B:
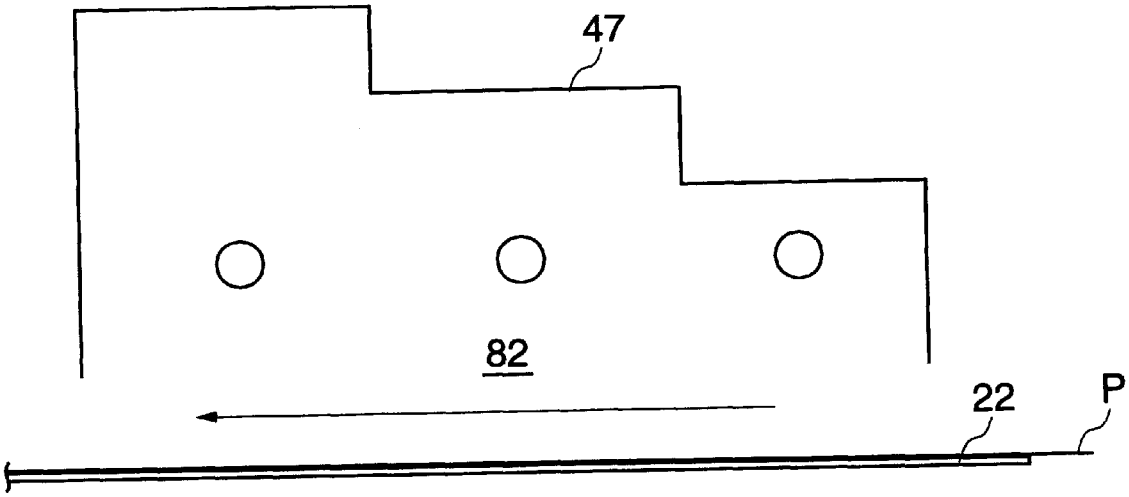

Though the top face of the reflector 32 is disposed parallel to the platen 22 in this example, as shown in FIGS. 9A and 9B, the reflectors 45, 47 may be provided with stepped parts.

In FIG. 9A, the distance of near infrared light of the halogen lamp 35 (300 W) reflected toward the recording paper P by the reflector 45 is taken to be L1, and the distance of near infrared light of the halogen lamp 36 (300 W) reflected toward the recording paper P by the reflector 45 is taken to be L2.

Thus, the height of the top face of the reflector 45 is varied to adjust the intensity of near infrared light reflected by the reflector 45, so that the temperature of the moving recording paper P is kept substantially constant on the upstream and on the downstream of the drying region 82.

Figure 10A:
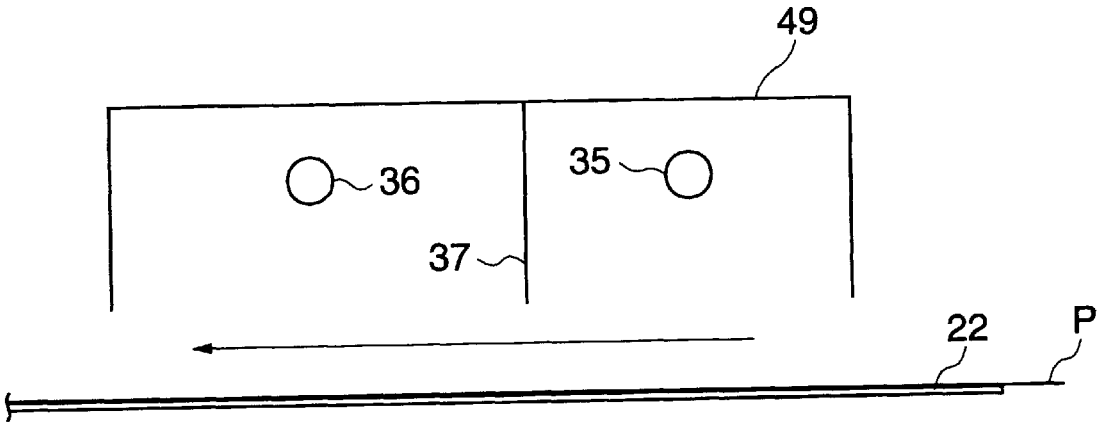
FIGS. 10A and 10B are schematic diagrams showing the condition where the reflector used in the drying device according to the embodiment of the invention is provided with a partition plate.

As shown in FIG. 10A, the reflector 49 may be provided with a partition plate 37, thereby partitioning between the halogen lamps 35 (300 W) and 36 (300 W).

Thus, even with the halogen lamps 35, 36 having the same output, the sizes of the partitioned parts are varied to adjust the radiation heat amount given to the moving recording paper P, so that the temperature of the recording paper P is kept substantially constant on the upstream and the downstream of the drying region 82.

Figure 10B:
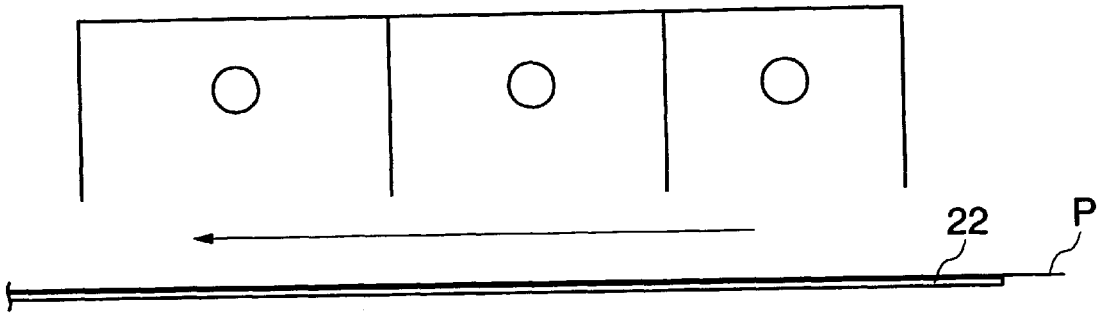

As shown in FIG. 10B, the partition plate 37 may be provided in two places of the reflector 51, thereby partitioning among the halogen lamps 39 (200 W), 41 (200 W), 43 (200 W).

On the other hand, as shown in FIGS. 1 and 2, a partition wall 38 is hung down from the ceiling part of the housing 14 toward the reflector holder 34. By the partition wall 38, the interior of the housing 14 is divided into an inlet passage 40 and an exhaust passage 42.

An inlet fan 44 is provided on the ceiling part of the inlet passage 40. On the other hand, in the housing 14, a partition plate 46 is provided parallel to the reflector 32 between the inlet fan 44 and the reflector 32, thereby receiving the outside air sucked by the inlet fan 44 at the face.

Thus, the outside air sucked by the inlet fan 44 falls straight down so that the temperature of the halogen lamp 36 will not fall suddenly. Accordingly, the efficiency of drying the recording paper P will not be decreased.

On the other hand, the longitudinal end of the exhaust passage 42 is provided with an exhaust fan 62. Therefore, the moist air contacting the print surface of the recording paper P is quickly discharged so that dew condensation in the housing 14 can be prevented.

Further, the air containing moisture of ink due to drying of the recording paper P and the air whose temperature is raised by the halogen lamp 36 can be quickly discharged, whereby the humidity and temperature of air in the drying region 82 can be kept constant to prevent scorching of the recording paper P.

The flow of wind circulated in the housing 14 will now be described.

As shown in FIG. 2, the outside air is sucked by the inlet fan 44 disposed above the housing 14 and fed into the housing 14. The outside air sucked by the inlet fan 44 once strikes the partition plate 46 and then passes between the end of the partition plate 46 and the partition wall 38.

At this time, the velocity of outside air fed into the housing 14 is equalized extending over the whole region in the longitudinal direction of the housing 14 (in the cross direction of the transported recording paper P).

Subsequently, the outside air passes through the blowing air 66 provided between the partition plate 46 and the reflector holder 34 and passes through the space between the reflector holder 34 and the side wall 14A of the housing 14. In the meantime, the outside air is slightly warmed by heat conducted to the reflector holder 34 to become hot air.

The side wall 14A of the housing 14 is provided with a guide piece 58 bent toward the transport direction of the recording paper P, thereby guiding the hot air which is rectified by the partition plate 46 and flowed downward between the reflector holder 34 and the side wall 14A above the platen 22 in the transport direction of the recording paper P.

By the guide piece 58, the hot air is surely guided from the lower end part of the side wall 14A of the housing 14 above the platen 22 in the transport direction of the recording paper P so that the hot air hardly leaks outside the housing 14 so as to improve the drying efficiency.

Subsequently, the hot air is guided to the blowing space 50 formed between the plate 28 and the platen 22 surface. The hot air is rectified by the plate 28, so that the wind velocity in the drying region 82 is constant.

On the print surface of the recording paper P transported on the platen 22, ink impacted in the recording paper P is dried in a short time both by radiation heat of the halogen lamp 35 and by the hot air warmed by the halogen lamp 35. Further, the outside airflows round the reflector holder 34 to prevent the halogen lamp 35 from being overheated and restrain a temperature rise near the periphery.

In the case where the halogen lamps 35, 36 have the same output, the surface temperature of the recording paper P and the temperature of hot air rise as they go downstream, but the output of the halogen lamp 36 is made lower than that of the halogen lamp 35 so that the temperature of the moving recording paper P is kept substantially constant on the upstream and on the downstream of the drying region 82.

The hot air which has passed above the platen 22 from the upstream to the downstream passes through the space between the reflector holder 34 and the side wall of the housing 14 to be discharged to the outside through the exhaust passage 42 by the exhaust fan 62.

In this case, the velocity of an airflow rectified by the plate 28 is 1 m/sec or faster. Thus, the airflow is passed above the recording paper P surface at a rate of 1 m/sec, whereby even if a jam of the recording paper P occurs in the drying device 10 and the recording paper P is exposed to radiation heat for a long time, the recording paper can be kept from being overheated so as to prevent the occurrence of scorching, fuming or the like.

Figure 11:
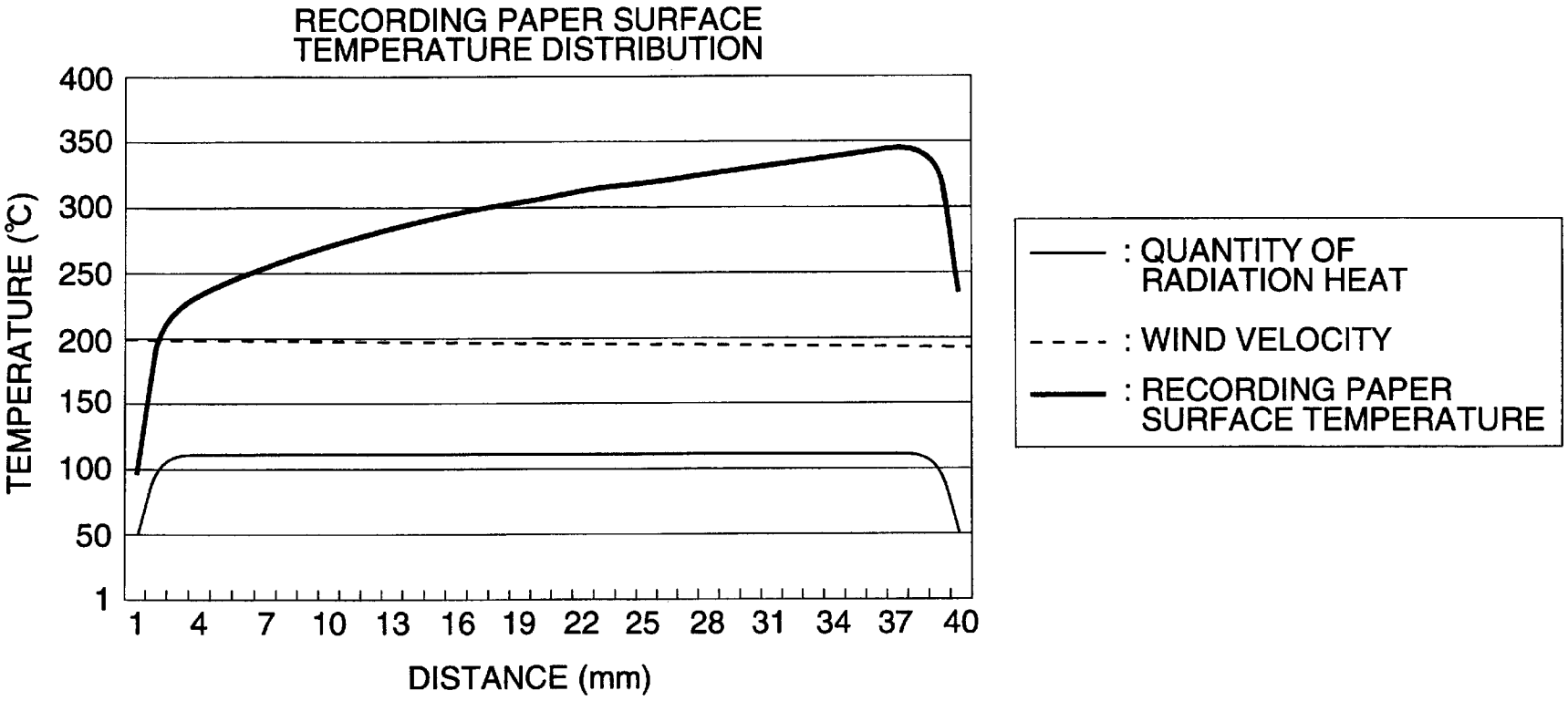
FIG. 11 is a diagram showing the distribution of temperature on the recording paper surface in the case where the output of two halogen lamps used in the drying device is equal.
Figure 12:
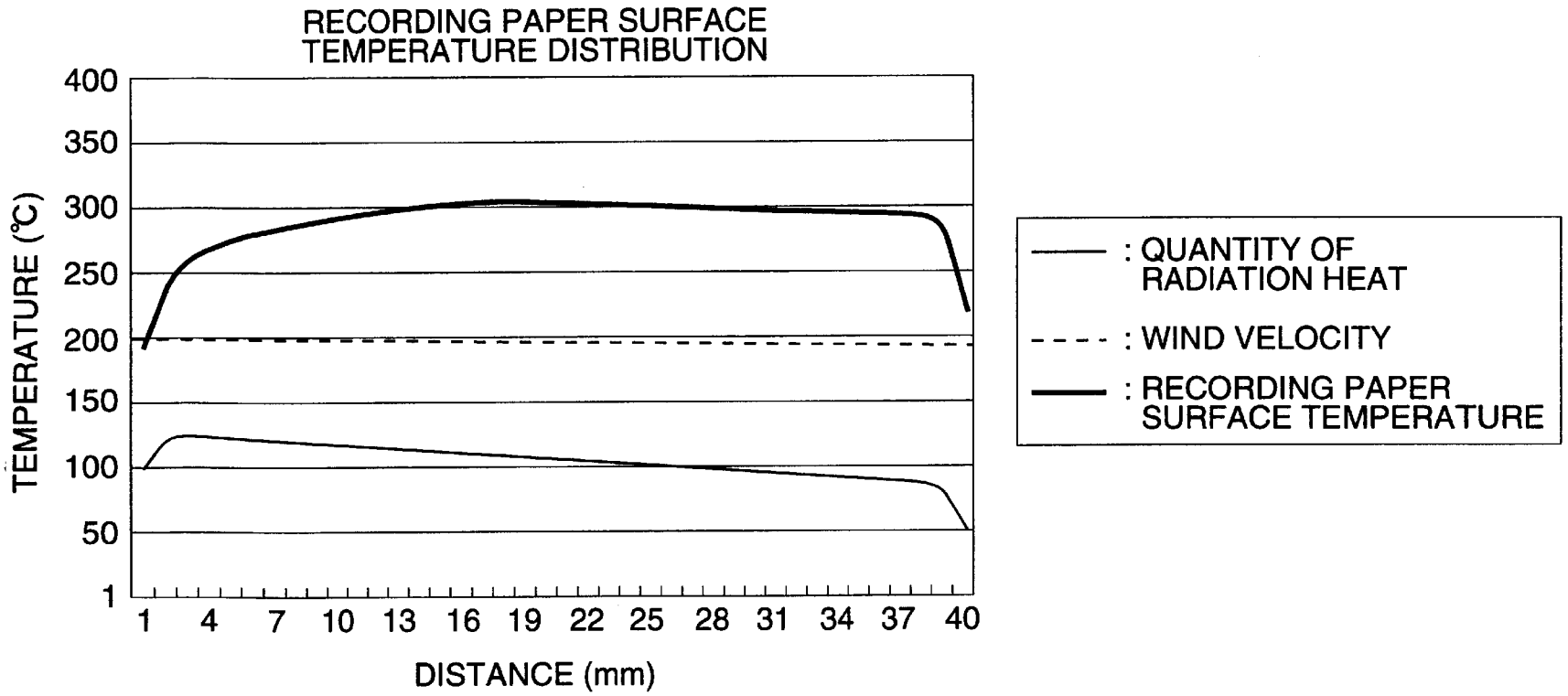
FIG. 12 is a diagram showing the distribution of temperature on the recording paper surface in the case of using the drying device according to the embodiment of the invention.
Figure 13:
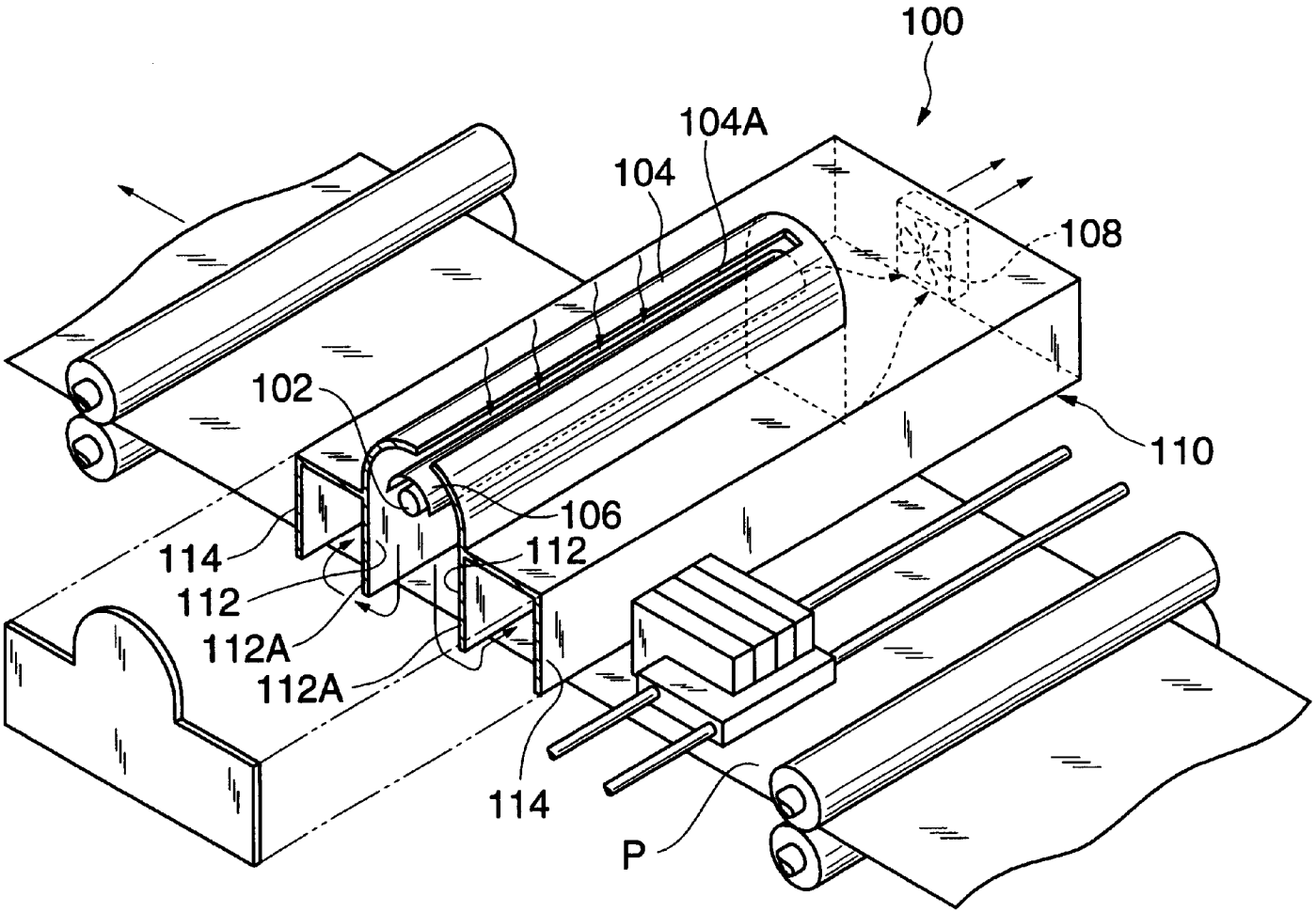
FIG. 13 is a perspective view showing a drying device according to the prior art.

FIGS. 11 and 12 are diagrams showing the temperature distribution on the recording paper P surface, in which the surface temperature of the recording paper P in an arbitrary position is measured, taking the upstream of the drying region 82 as a reference.

FIG. 11 shows the temperature distribution on the recording paper P surface in the case where the halogen lamps 35, 36 used in the drying device 10 have the same output. By the halogen lamps 35, 36, the radiation heat amount is kept constant on the upstream and on the downstream in the drying region 82. Further, the wind velocity in the drying region 82 is kept substantially constant by the plate 28.

Accordingly, the temperature on the recording paper P surface gradually rises as it goes downstream.

On the contrary, FIG. 12 shows the temperature distribution on the recording paper P surface in the case of using the drying device 10 of the embodiment and decreasing the output of the halogen lamps 35, 36 given to the recording paper P as it goes downstream (see FIGS. 6A and 6B). Thus, the temperature on the moving recording paper P surface is substantially constant on the upstream and on the downstream in the drying region 82.

According to the invention, in the case where the velocity of the airflow in the space is constant, for example, comparing the upstream with the downstream in the drying region (space), the surface temperature of the recording paper is lower on the upstream and the temperature of outside air blown into the drying region is lower, so the radiation heat amount on the upstream is made larger than that on the downstream. Thus, the radiation heat amount is adjusted so that the temperature of the moving recording paper is substantially constant on the upstream and on the downstream in the drying region. On the other hand, in the case where the velocity of the airflow is different in the drying region, the radiation heat amount in the higher-speed region is made larger than that in the lower-speed region. Thus, the radiation heat amount is varied according to the velocity of the airflow, whereby the recording paper can be evenly dried, and even if a jam of the recording paper occurs in the drying device, there is no possibility of scorching, fuming or the like.

According to one aspect of the invention, the wind velocity in the drying region is constant so that the recording paper can be evenly dried. According to another aspect of the invention, even if a jam of the recording paper occurs in the drying device and the recording paper is exposed to radiation heat for a long time, the recording paper can be kept from being overheated so as to prevent the occurrence of scorching, fuming or the like. According to another aspect of the invention, even in the case where the velocity of airflow is decreased as it goes downstream in the drying region by start wheels and the like disposed in the drying region, lowering of the airflow velocity can be prevented by reducing the ventilation area on the downstream.

What is claimed is:

1. A drying device, comprising:

plural heating elements disposed in a housing demarcating a drying region for drying a recording sheet printed by an ink jet head;

a platen disposed below the heating elements, to which the recording sheet is transported;

a reflector that reflects radiation heat of the heating elements toward the platen; and an airflow generating unit that generates an airflow in a space formed between the heating elements and a surface of the platen.

2. A drying device, comprising:

plural heating elements disposed in a housing demarcating a drying region for drying a recording sheet printed by an ink jet head;

a platen disposed below the heating elements, to which the recording sheet is transported;

a reflector that reflects radiation heat of the heating elements toward the platen;

an airflow generating unit that generates an airflow in a space formed between the heating elements and a surface of the platen; and an energy adjusting unit that keeps substantially constant the temperature of the recording sheet moved in the space.

3. The drying device according to claim 2, wherein the energy adjusting unit varies an output of each of the plural heating elements disposed along the transport direction of the recording sheet.

4. The drying device according to claim 2, wherein the energy adjusting unit individually varies a clearance between each of the plural heating elements disposed along the transport direction of the recording sheet and the platen.

5. The drying device according to claim 2, wherein the energy adjusting unit varies a space between the plural heating elements disposed along the transport direction of the recording sheet.

6. The drying device according to claim 2, wherein the energy adjusting unit varies the distance of the reflector to the platen.

7. The drying device according to claim 2, wherein the energy adjusting unit is a partition plate for partitioning off each of the plural heating elements disposed along the transport direction of the recording sheet to demarcate each of the heating elements.

8. A drying device, comprising:

plural heating elements disposed in a housing demarcating a drying region for drying a recording sheet printed by an ink jet head;

a platen disposed below the heating elements, to which the recording sheet is transported;

a reflector that reflects radiation heat of the heating elements toward the platen;

an airflow generating unit that generates an airflow in a space formed between the heating elements and a surface of the platen; and an airflow rectification unit, disposed in the space to face the platen, that rectifies the airflow.

9. The drying device according to claim 8, wherein the velocity of the airflow rectified by the airflow rectification unit is 1 m/sec or faster.

10. The drying device according to claim 8, wherein a ventilation area on the downstream in the space formed between the airflow rectification unit and the platen is made smaller than that on the upstream.

11. The drying device according to claim 8, wherein the airflow rectification unit is a plate having an infrared ray transmittance of 90% or more.

12. The drying device according to claim 11, wherein the plate is made of heat resisting glass.

13. A drying device, comprising:

plural heating elements disposed in a housing demarcating a drying region for drying a recording sheet printed by an ink jet head;

a platen disposed below the heating elements, to which the recording sheet is transported;

a reflector that reflects radiation heat of the heating elements toward the platen;

an airflow generating unit that generates an airflow in a space formed between the heating elements and a surface of the platen;

an airflow rectification unit, disposed in the space to face the platen, that rectifies the airflow; and an energy adjusting unit that keeps substantially constant the temperature of the recording sheet moved in the space.

* * * * *